United States Patent [19]

Boronkay et al.

[11] 4,110,677

[45] Aug. 29, 1978

[54] OPERATIONAL AMPLIFIER WITH POSITIVE AND NEGATIVE FEEDBACK PATHS FOR SUPPLYING CONSTANT CURRENT TO A BANDGAP VOLTAGE REFERENCE CIRCUIT

[75] Inventors: Attila D. Boronkay, Santa Ana; Charles G. Axen, Irvine, both of Calif.

[73] Assignee: Beckman Instruments, Inc., Fullerton, Calif.

[21] Appl. No.: 841,411

[22] Filed: Oct. 12, 1977

Related U.S. Application Data

[63] Continuation of Ser. No. 772,371, Feb. 25, 1977, abandoned.

[51] Int. Cl.[2] ..... G05F 1/58

[52] U.S. Cl. ..... 323/19; 307/297; 323/4; 330/104

[58] Field of Search ..... 323/1, 4, 9, 19, 22 T, 323/24, 22 R, 69; 307/296, 297; 330/75, 101, 103, 104, 289, 290, 291, 293

[56] References Cited

U.S. PATENT DOCUMENTS

| | | | |
|---|---|---|---|
| 3,617,859 | 11/1971 | Dobkin | 323/4 |
| 3,735,242 | 5/1973 | Anderson | 323/22 T |
| 3,828,240 | 8/1974 | Keller et al. | 323/22 T |
| 3,887,863 | 6/1975 | Brokaw | 323/19 |
| 3,917,993 | 11/1975 | Picmaus et al. | 330/104 |
| 4,017,788 | 4/1977 | Stepp et al. | 323/69 |

OTHER PUBLICATIONS

*IEEE Trans. Broadcast & Telereceivers*, vol. BTR-18, No. 2, May 1972; "A New Dimension to Monolithic Voltage Regulators", by Chu & Oswald; pp. 73-76.

*Primary Examiner*—Gerald Goldberg
*Attorney, Agent, or Firm*—R. J. Steinmeyer; R. R. Meads; J. R. Shewmaker

[57] ABSTRACT

A voltage regulator circuit including an operational amplifier having supply voltage terminals connected to a source of unregulated supply voltage and a two-terminal, essentially zero temperature coefficient, semiconductor bandgap voltage reference circuit connected in a negative feedback path between the output terminal and one input terminal of the amplifier. The amplifier provides a constant current source for the bandgap voltage reference circuit, and the amplifier and reference circuit cooperate to establish a regulated output voltage at the amplifier output terminal. A resistive divider network is connected in a positive feedback path between the output and a second input terminal of the amplifier to establish the value of the regulated voltage within a range of values between the bandgap voltage and the unregulated supply voltage.

2 Claims, 2 Drawing Figures

OPERATIONAL AMPLIFIER WITH POSITIVE AND NEGATIVE FEEDBACK PATHS FOR SUPPLYING CONSTANT CURRENT TO A BANDGAP VOLTAGE REFERENCE CIRCUIT

This is a continuation of application Ser. No. 772,371, filed Feb. 25, 1977, now abandoned.

BACKGROUND OF THE INVENTION

1. Field of the Invention

The present invention relates generally to voltage regulator circuits and, more particularly, to regulator circuits for supplying a regulated and adjustable output voltage.

2. Description of the Prior Art

U.S. Pat. No. 3,617,859 discloses a so-called "bandgap" voltage reference circuit recently adopted in many semiconductor integrated circuit voltage regulators. The circuit employs three cascaded, matched transistors formed in a common substrate and utilizes the temperature dependent characteristics of a transistor emitter-base voltage to achieve a regulator circuit exhibiting an essentially zero temperature coefficient. The three transistors are coupled in a manner such that the negative temperature coefficient of the emitter-base voltage of one transistor is compensated or offset by the positive temperature coefficient of the emitter-base differential voltage between the remaining two transistors which are operated at greatly different current levels.

In the aforementioned patent, the zero temperature coefficient, bandgap voltage reference circuit is connected across the inverting and noninverting input terminals of an operational amplifier having an output terminal adapted to supply a regulated output voltage. The source of unregulated voltage is connected to a supply input terminal of the operational amplifier and to one terminal of the bandgap voltage reference circuit through a current source. While this voltage regulator circuit arrangement is satisfactory for many applications, it exhibits a number of drawbacks. For example, the circuit is suitable for only a very limited change in load and will supply only a very low value of regulated voltage slightly above the theoretical semiconductor energy bandgap voltage (e.g., about 1.5 volts for silicon transistors). Thus, the designation as a "bandgap" voltage regulator. To supply higher regulated voltages, several circuit units must be "stacked" to arrive at multiples of 1.5 volts. Moreover, separate active current supplying devices are required for the bandgap voltage reference circuit and for the operational amplifier. In addition, the circuit exhibits a relatively high standby power consumption. This is particularly undesirable in applications where the source of unregulated voltage applied to the regulator circuit is derived from a battery. For example, portable, battery powered electrochemical measuring systems, for measuring ion concentration such as solution pH, require a stable regulated reference voltage during measurement. Obviously, if the battery is unnecessarily drained during standby intervals, the usefulness of such measuring systems in the field is compromised.

As a result, a need exists for a voltage regulator circuit exhibiting the advantages of the prior circuit, such as inherent temperature stability, without the standby current drain and other disadvantages. The present invention meets these needs.

SUMMARY OF THE INVENTION

The present invention resides in a new and improved voltage regulator circuit which overcomes the disadvantages of the prior art. In its broader aspects, the present invention contemplates a voltage regulating circuit which comprises an operational amplifier having supply voltage terminals connected across a source of unregulated supply voltage and an essentially zero temperature coefficient, bandgap voltage reference circuit connected in a negative feedback path between an output terminal and one input terminal of the amplifier. The amplifier functions as a source of constant current for the bandgap voltage circuit and the amplifier and the bandgap circuit combine to supply a regulated output voltage at the amplifier output terminal. A positive feedback network is connected to a second input terminal of the amplifier for adjusting the value of the regulated output voltage between the bandgap and the supply voltage values. This arrangement (1) eliminates the need for separate current sources supplying the bandgap voltage reference circuit and the amplifier, (2) supplies an adjustable regulated voltage level, and (3) draws minimal standby current. Other advantages of the invention will become apparent from the following detailed description taken in conjunction with the illustrated drawing in which:

DESCRIPTION OF THE PREFERRED EMBODIMENT

Figure 2:
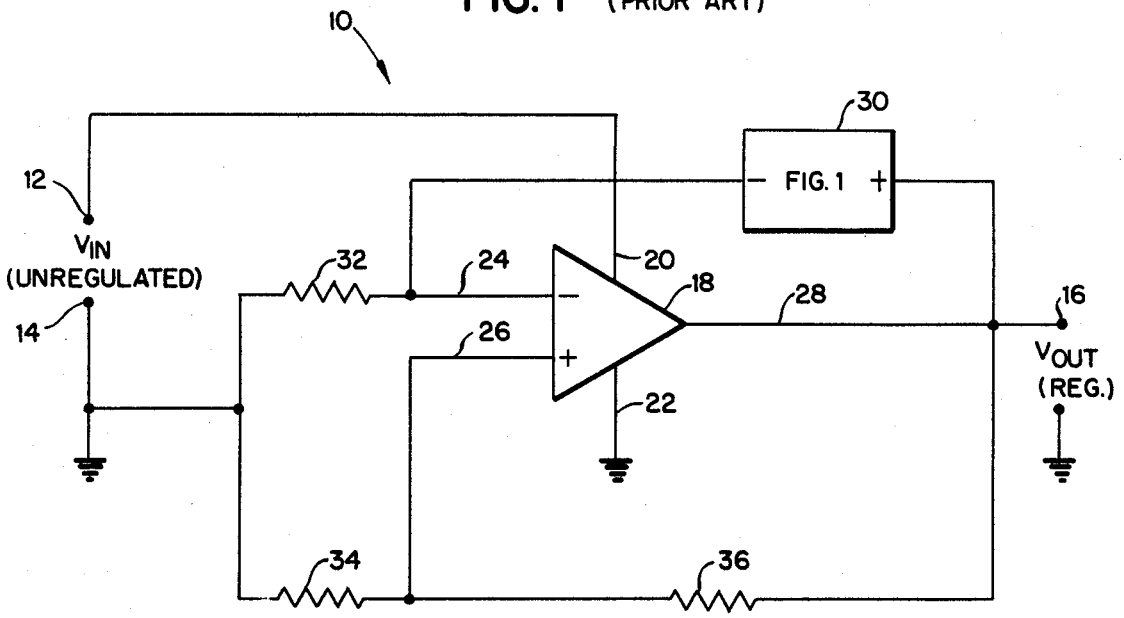
FIG. 2 is a circuit diagram of the voltage regulator circuit of the invention as incorporating a zero temperature coefficient bandgap voltage reference circuit such as that of FIG. 1.

As illustrated in FIG. 2 of the drawings, the present invention is embodied in a voltage regulator circuit, identified generally by numeral 10, having voltage supply terminals 12 and 14 across which a source of unregulated voltage ($V_{in}$) is connected and an output terminal 16 at which a regulated output voltage ($V_{out}$) is supplied for application to a utilization device. The circuit includes a high gain operational amplifier 18 having first and second supply voltage terminals 20 and 22 respectively connected to the source of unregulated supply voltage $V_{in}$. Amplifier 18 further includes an inverting input terminal 24, a noninverting input terminal 26, and an output terminal 28 coupled to the regulator circuit output terminal 16.

In accordance with the present invention a two-terminal, essentially zero temperature coefficient, bandgap voltage reference circuit 30 is connected in a negative feedback path between output terminal 28 and inverting input terminal 24 of operational amplifier 18. A resistor 32 is connected between the voltage supply terminal 14 (e.g., ground) and a junction of the voltage reference circuit 30 and the inverting input terminal 24. Thus arranged, the amplifier functions as a constant current source for the reference circuit 30, supplying a constant current through circuit 30 and resistor 32, and the amplifier and circuit combine to develop a regulated voltage at the output terminal 16.

In addition, a positive feedback network 33 comprising first and second series connected resistive sections 34 and 36 is connected between output terminal 28 and the voltage supply terminal 14. A junction of the resistive sections 34 and 36 is connected to the noninverting input terminal 26 of the operational amplifier. As will be described hereinafter, the relative values of the resistive sections establish the value of the regulated voltage developed at the output terminal 16.

Figure 1:
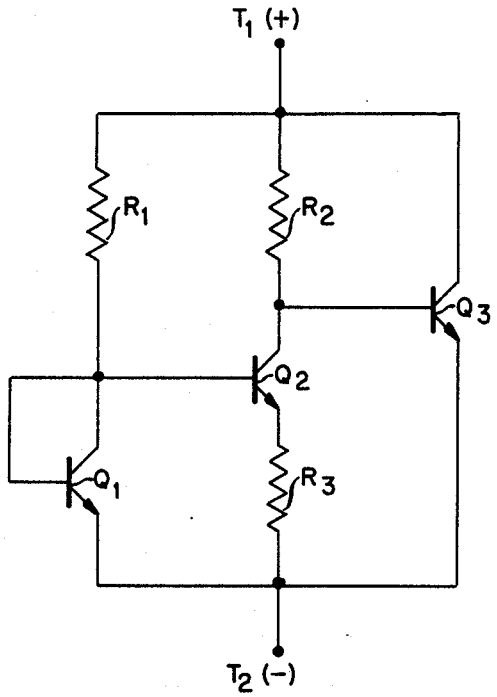
FIG. 1 (PRIOR ART)
FIG. 1 is a schematic circuit diagram of a prior art zero temperature coefficient bandgap voltage reference circuit.

The zero temperature coefficient, bandgap voltage reference circuit 30 may take the form illustrated in FIG. 1 as disclosed in the aforementioned patent. As shown, the circuit includes first, second and third cascaded transistors Q1, Q2, and Q3, formed in a common substrate and coupled with their collector-emitter conduction paths disposed in parallel between first and second terminals T1 and T2 of the two terminal circuit. The collectors of transistors Q1 and Q2 are connected to terminal T1 through respective resistors R1 and R2, while the emitter of Q2 is connected to terminal T2 through resistor R3. Transistor Q1 has its base directly connected to its collector.

Reference is made to the aforementioned patent for details regarding the operation of the voltage reference circuit. Briefly, R1 and R3 are equal and R2 is greater than R1, e.g., 10R1, to establish a substantially higher current flow through transistor Q1 than through transistor Q2. Because of the different current levels through Q1 and Q2, Q2 has a smaller emitter-base voltage than Q1 and the differential emitter-base voltage between transistors Q1 and Q2 appears across resistor R3. The differential emitter-base voltage exhibits a positive temperature coefficient. By contrast, the emitter-base voltage across transistor Q3 exhibits a negative temperature coefficient which offset each other to provide a net zero temperature coefficient.

As a result, by connecting a source of constant current to the voltage reference circuit 30, a reference voltage across terminals T1 and T2 will be supplied having a value approximately that of the theoretical energy bandgap voltage, approximately 1.5 volts for silicon transistors Q1–Q3.

In the regulator circuit of the present invention, terminal T1 of reference circuit 30 is connected to operational amplifier output terminal 28 and terminal T2 is connected to inverting input terminal 24. In operation, operational amplifier 18 attempts to drive any voltage difference between input terminals 24 and 26 to a zero value. In so doing a constant current flow is established from output terminal 28 through bandgap voltage reference circuit 30 and resistor 32 to common terminal 14 and a regulated voltage is developed at output terminal 16. The actual value of the regulated output voltage is established by the relative values of resistance sections 34 and 36 connected between terminal 16 and common terminal 14. It thus may be seen that the combination of the zero temperature coefficient, bandgap voltage reference circuit 30 and the three resistance sections 32, 34 and 36 serve to establish a very stable regulated output voltage $V_{out}$. Operational amplifier 18 dynamically adapts to the output load.

Referring to the circuit of the invention, resistive sections 34 and 36 provide a positive feedback divider having an attenuation $\alpha = R_{34}/(R_{34} + R_{36})$. The Kirchhoff voltage equation of the voltage regulator circuit is $V_{out} = -G(V_{out} - V_{ref}) + G\alpha V_{out}$ where G is the gain of amplifier 18 and $V_{ref}$ is the voltage across bandgap voltage reference circuit 30. It can be shown that $V_{out} \approx V_{ref}/(1 - \alpha)$ assuming that the gain G of the operational amplifier is large and thus 1/G approaches zero. From the latter equation it will be evident that by adjustment of the relative values of resistive sections 34 and 36, the regulated voltage $V_{out}$ can be adjusted from a level slightly above $V_{ref}$ (approximately 1.7 volts) to a level slightly below the supply voltage limit $V_{in}$ of the operational amplifier (typically 30 volts or higher).

The value of resistor 32 is selected to optimize the current level through the voltage reference circuit 30. In this regard $R_{32} = (V_{out} - V_{ref})/I_{ref}$ where $I_{ref}$ is the optimized current level of the voltage reference circuit 30.

Micropower operational amplifiers can operate at as low as 20 microamps standby current level and in the present configuration the voltage reference circuit 30 will function with as low as 50 microamps standby current, providing a combined standby current of as low as 70 microamperes and allowing a maximum load of 1.5 mA with a better than 1 mV stability.

While the values of the circuit components of the invention may vary depending on the application of the circuit, in one successfully operated circuit, representative component values were:

| | |
|---|---|
| Voltage Source ($V_{in}$) - 9V battery (7 to 10 volts) | |
| Regulated Voltage ($V_{out}$) - 3.0 volts | |
| $R_{32}$ - 22.6 K ohm | |
| $R_{34}$ - 226 K ohm (selected for $V_{out}$ = 3 volts) | |
| $R_{36}$ - 274 K ohm | |
| Operational Amplifier 18 - National Semic. LM4250 | |
| $Q_1$ - | e.g. National Semicon. LM3045D |
| $Q_2$ - | |
| $Q_3$ - | |
| $R_1$ - 30.1 K ohm | |
| $R_2$ - 301 K ohm | |
| $R_3$ - 19.1 K ohm | |

It can thus be seen that the present invention provides a versatile voltage regulating circuit for supplying an adjustable and regulated output voltage with the inherent temperature stability of the prior art but with a reduced standby current drain. The circuit of the invention is thus particularly adapted for use in precision voltage applications utilizing battery sources. Moreover, while a preferred embodiment of the invention has been illustrated and described, modifications may be made therein without departing from the spirit of the invention as defined in the appended claims.

What is claimed is:

1. A voltage regulator comprising:

an operational amplifier having supply voltage terminals connected across a source of unregulated supply voltage, inverting and noninverting input terminals, and an output terminal;

an essentially zero temperature coefficient, bandgap voltage reference circuit;

circuit means connecting said voltage reference circuit in a negative feedback path for said amplifier between said output and said inverting input terminals such that said amplifier functions as a constant current source for said voltage reference circuit and said amplifier and voltage reference circuit combine to supply a regulated voltage at said output terminal; and a positive feedback network for said amplifier between said output and noninverting input terminals for establishing the value of said regulated voltage.

2. A voltage regulating circuit comprising:

an operational amplifier having an inverting input terminal, a noninverting input terminal, an output terminal, and a pair of supply voltage receiving terminals;

means for connecting said supply voltage receiving terminals to a source of unregulated supply voltage;

a two terminal, essentially zero temperature coefficient, bandgap voltage reference circuit;

means for connecting said voltage reference circuit in a negative feedback path between said output terminal and said inverting input terminal;

a voltage divider network having first and second resistive sections;

means for connecting said network between said output terminal and one of said supply voltage receiving terminals for establishing a voltage thereacross;

means connecting a junction of said resistive sections to said noninverting input terminal for establishing a positive feedback path between said output terminal and said noninverting input terminal, the relative resistance values of said resistive sections establishing a regulated output voltage level at said output terminal; and resistance means connected between said one supply voltage terminal and a junction of said voltage reference circuit and said inverting input terminal for establishing a constant current flow in said negative feedback path through said voltage reference circuit.

* * * * *